US008267491B2

(12) United States Patent
Artsiely

(10) Patent No.: US 8,267,491 B2
(45) Date of Patent: Sep. 18, 2012

(54) VENDING MACHINE COMPARTMENT ASSEMBLY

(75) Inventor: Eyal Artsiely, Bikat Yericho (IL)

(73) Assignee: Hotel Outsource Management International, Inc., New York, NY (US)

( * ) Notice: Subject to any disclaimer, the term of this patent is extended or adjusted under 35 U.S.C. 154(b) by 665 days.

(21) Appl. No.: 12/436,895

(22) Filed: May 7, 2009

(65) Prior Publication Data

US 2010/0281932 A1 Nov. 11, 2010

(51) Int. Cl.
*A47B 49/00* (2006.01)
*E05B 65/06* (2006.01)

(52) U.S. Cl. ..... 312/326; 221/18; 221/168; 221/162; 221/180; 221/242; 221/241; 221/158; 221/159; 221/172; 221/578; 221/68; 221/264; 81/433; 81/435; 81/436; 81/452; 81/190; 81/57.37; 312/223.3; 312/57.37; 364/479.14

(58) Field of Classification Search ..... 312/57.37, 312/223.3, 326; 81/433, 435, 436, 452, 190, 81/57.37; 221/18, 168, 162, 180, 242, 241, 221/158, 159, 172, 578, 68, 264; 70/101; 364/479.14
See application file for complete search history.

(56) References Cited

U.S. PATENT DOCUMENTS

| | | | | |
|---|---|---|---|---|
| 4,396,106 | A * | 8/1983 | Mehlan et al. | 194/302 |
| 4,615,570 | A * | 10/1986 | Goodman | 312/110 |
| 4,925,258 | A * | 5/1990 | Ludwig et al. | 312/323 |
| 5,524,943 | A * | 6/1996 | Bottaro | 292/56 |
| 5,905,653 | A * | 5/1999 | Higham et al. | 700/244 |
| 6,076,906 | A * | 6/2000 | Royal | 312/273 |
| 6,415,952 | B1 * | 7/2002 | Ohtuka et al. | 221/103 |
| 7,278,569 | B2 * | 10/2007 | Cohen et al. | 235/378 |
| 7,490,914 | B2 * | 2/2009 | Greiner | 312/321.5 |
| 2005/0012437 | A1 * | 1/2005 | Schulman | 312/223.3 |
| 2005/0206287 | A1 * | 9/2005 | House | 312/408 |
| 2008/0129171 | A1 * | 6/2008 | Greiner | 312/348.3 |
| 2009/0293562 | A1 * | 12/2009 | Fisher et al. | 70/278.7 |
| 2010/0070074 | A1 * | 3/2010 | Duncan et al. | 700/242 |
| 2010/0236298 | A1 * | 9/2010 | James et al. | 70/78 |

* cited by examiner

*Primary Examiner* — Gene O. Crawford
*Assistant Examiner* — Rakesh Kumar
(74) *Attorney, Agent, or Firm* — Dekel Patent Ltd.; David Klein

(57) ABSTRACT

Apparatus including a vending machine compartment including a dispensing door openable to permit removal of merchandise from the compartment, the compartment being pivotedly connected to a box assembly, and wherein the dispensing door includes a link element that is constrained to move along a track formed in the box assembly such that the dispensing door is not openable at a first portion of the track and is openable at a second portion of the track.

12 Claims, 16 Drawing Sheets

VENDING MACHINE COMPARTMENT ASSEMBLY

FIELD OF THE INVENTION

The present invention relates generally to vending machines, and particularly to a modular vending machine assembly with multiple compartments for vendable items.

BACKGROUND OF THE INVENTION

Vending machines are well known for vending items other than beverages, such as snacks, nuts, candies, toys and other food and non-food items. Vending machines typically have clear glass or plastic compartments which retain the product to be vended.

However, prior art vending machines that vend more than one product tend to have cumbersome mechanisms.

SUMMARY OF THE INVENTION

The present invention seeks to provide a modular vending machine assembly with multiple compartments for vendable items, as is described more in detail hereinbelow.

There is thus provided in accordance with an embodiment of the present invention apparatus including a vending machine compartment including a dispensing door openable to permit removal of merchandise from the compartment, the compartment being pivotedly connected to a box assembly, and wherein the dispensing door includes a link element that is constrained to move along a track formed in the box assembly such that the dispensing door is not openable at a first portion of the track and is openable at a second portion of the track.

In accordance with an embodiment of the present invention, at the first portion of the track, the compartment pivots together with the dispensing door with respect to the box assembly.

In accordance with an embodiment of the present invention, at the first portion of the track, the dispensing door is constrained to abut against the compartment and at the second portion of the track the dispensing door is free to pivot and open without abutting against the compartment.

In accordance with an embodiment of the present invention a stopper is positioned relative to the dispensing door, such that upon movement of the dispensing door to the end of the first portion of the track, the stopper is deployed to a stop position that moving the dispensing door back to the first closed position prevents closing the dispensing door unless the merchandise was removed from the compartment. The stopper may be geometrically locked at the stop position.

In accordance with an embodiment of the present invention a refill actuation assembly is coupled to the stopper with a link arm, the link arm having a first position that retains the stopper in the stop position and a second position that releases the stopper from the stop position to permit closing and opening the dispensing door for refilling the compartment.

In accordance with an embodiment of the present invention a lock is provided for locking and unlocking the refill actuation assembly.

In accordance with an embodiment of the present invention a sensor (e.g., a microswitch) senses when the dispensing door is open.

In accordance with an embodiment of the present invention the box assembly includes a first connector and a second connector and the apparatus includes more than one box assembly, wherein adjacent box assemblies mate with each other by the first connector of one of the box assemblies mating with the second connector of an adjacent box assembly. For example, the first and second connectors may include male and female connectors (e.g., dovetail connectors).

In accordance with another embodiment of the present invention there is provided apparatus including a vending machine compartment including a dispensing door openable to permit removal of merchandise from the compartment, a stopper positioned relative to the dispensing door, such that upon movement of the dispensing door to the end of the first portion of the track, the stopper is deployed to a stop position that prevents moving the dispensing door back to the first closed position unless the merchandise was removed from the compartment, and a refill actuation assembly coupled to the stopper with a link arm, the link arm having a first position that retains the stopper in the stop position and a second position that releases the stopper from the stop position to permit closing and opening the dispensing door for refilling the compartment.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1A:
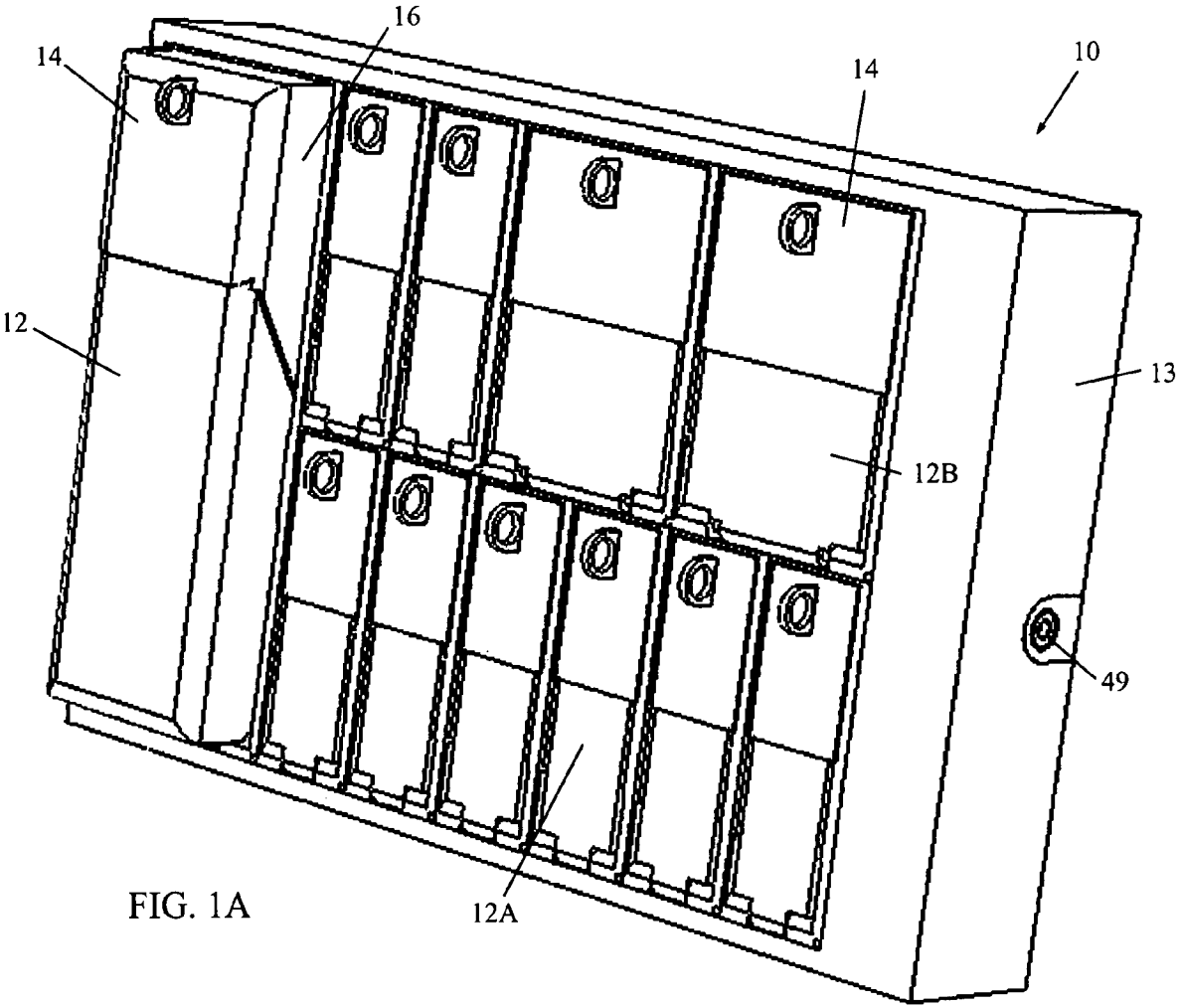
FIGS. 1A-1D are simplified pictorial illustrations of a vending machine assembly, constructed and operative in accordance with an embodiment of the present invention.

Reference is now made to FIG. 1A, which illustrates a vending machine assembly 10, constructed and operative in accordance with an embodiment of the present invention.

Vending machine assembly 10 includes one or more vending machine compartments 12 (or simply compartments 12 for short) mounted on a housing 13 and configured to contain therein merchandise for vending. Each compartment 12 includes a dispensing door 14 openable to permit removal of merchandise from the compartment 12. Each compartment is pivotedly connected to a box assembly 16, described further in detail hereinbelow. Housing 13 may be made of metal, wood or plastic and the like.

The compartments 12 may come in different sizes and shapes to accommodate different merchandise. For example, the compartment 12 on the left side of FIG. 1A is relatively slim and tall to accommodate therein a wine bottle, for example. The compartments 12A on the lower portion are relatively slim and short to accommodate therein a chocolate bar or small bottle, for example. The compartments 12B on the upper right are relatively wide and short to accommodate therein cashew packages, for example.

Figure 1C:
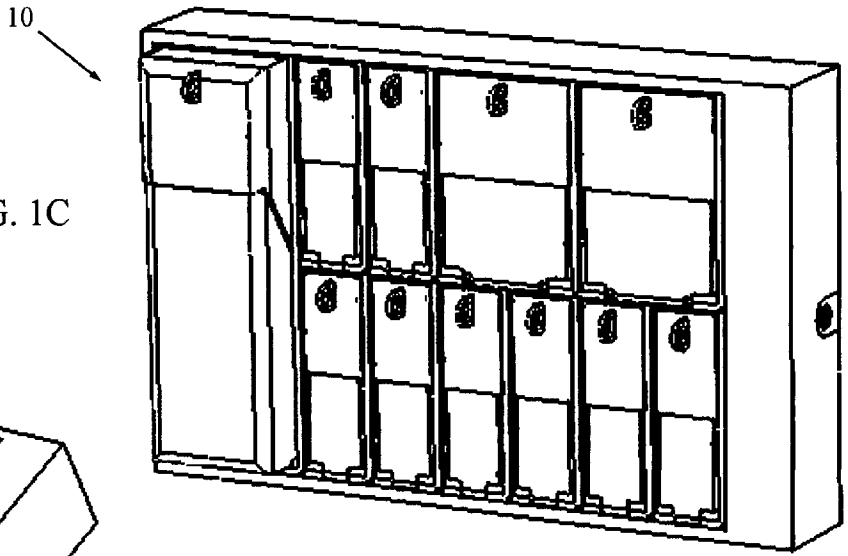
Figure 1D:
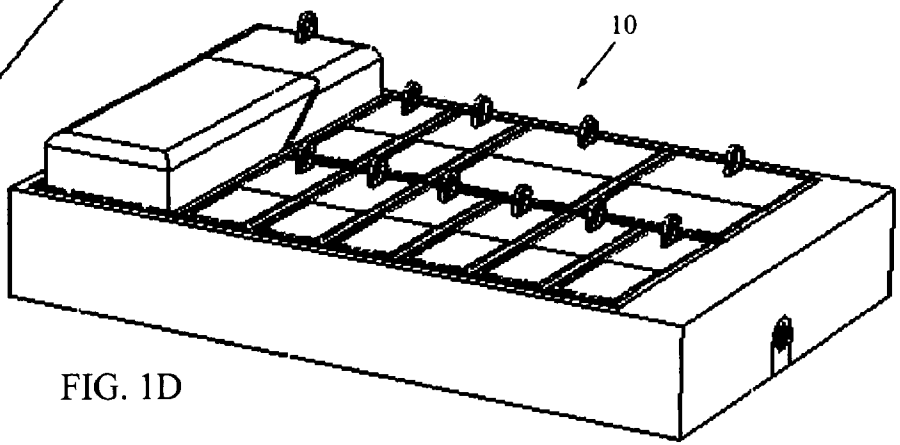
Figure 1B:
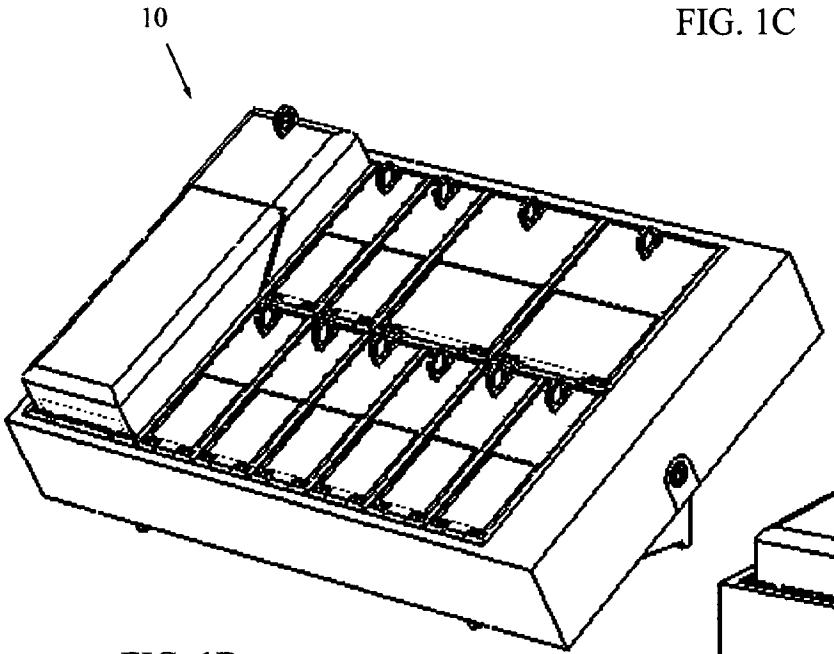

Vending machine assembly 10 may be placed at any attitude and position, such as sloped (FIG. 1B), standing vertically or hung on a wall (FIG. 1C), or laying horizontally (FIG. 1D).

Figure 2:
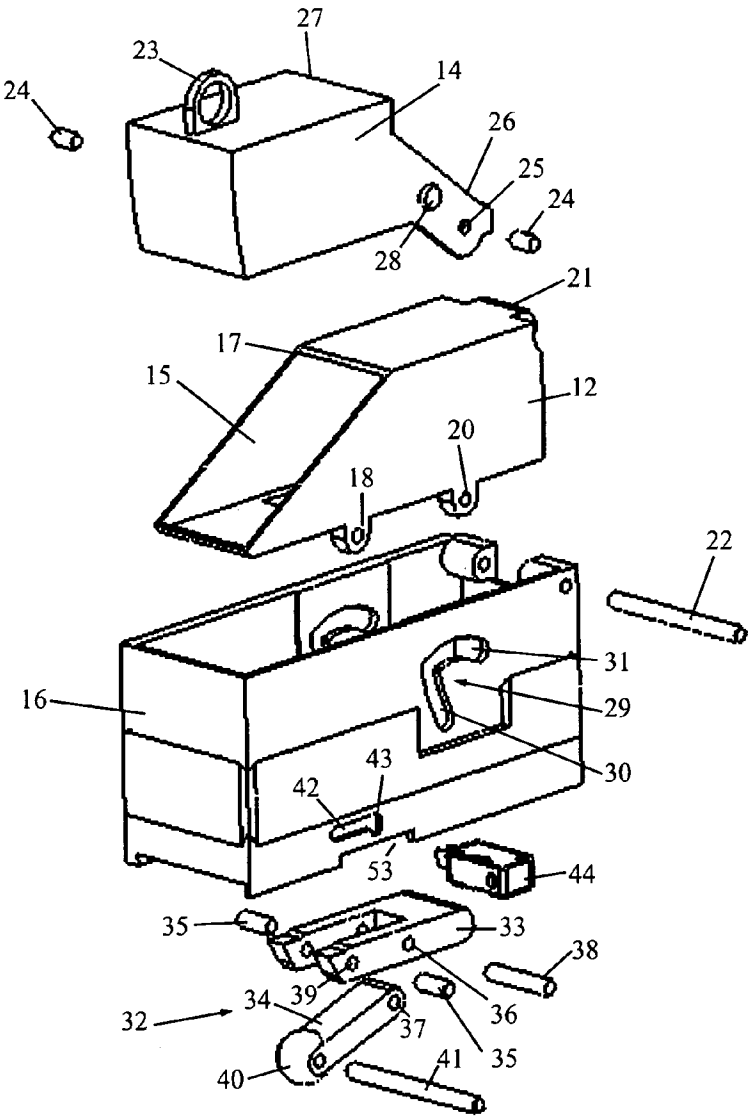
FIG. 2 is a simplified exploded pictorial illustration of a compartment of the vending machine assembly of FIGS. 1A-1D, constructed and operative in accordance with an embodiment of the present invention.

Reference is now made to FIG. 2, which illustrates compartment 12 in more detail. In the non-limiting illustrated embodiment, compartment 12 is formed as an open-ended box, wherein the open end 15 is slanted up to an upper edge 17. Compartment 12 includes four lugs—a pair of front lugs 18 and a pair of rear lugs 20 on opposite sides of compartment 12. Compartment 12 includes an upper hinge 21 for accepting therein an axle 22 for pivotedly connecting compartment 12 to box assembly 16.

Dispensing door 14 is formed with a handle 23 for grasping and opening door 14. Door 14 is pivotedly connected to compartment 12 by means of pins 24 that are received in rear lugs 20 and in apertures 25 formed in a leg 26 of door 14. Dispensing door 14 has a rear upper edge 27.

Dispensing door 14 includes a link element 28 that is constrained to move along a track 29 formed in box assembly 16. Track 29 has a first (somewhat vertical) portion 30 and a second (somewhat horizontal) portion 31. As will be described further below, dispensing door 14 is not openable at the first portion 30 of track 29 and is openable at the second portion 31 of track 29. A groove 53 is formed at the bottom of box assembly 16.

A stopper 32 is provided that controls movement of compartment 12. Stopper 32 includes a stopper element 33 pivoted to a leg element 34 by pins 38 that are received in holes 36 and 37 of stopper element 33 and leg element 34, respectively. Stopper element 33 is pivoted to compartment 12 by one or more pins 35 received in front lugs 18 and in apertures 39 of stopper element 33. Leg element 34 has a spherical end 40 that is constrained to move by means of a rod 41 in a lower track 42 formed in box assembly 16. Lower track 42 has an extension 43 at an end thereof.

In accordance with an embodiment of the present invention a sensor 44 (e.g., a microswitch) is provided that senses when the dispensing door 14 is open, as is described further below.

Figure 3:
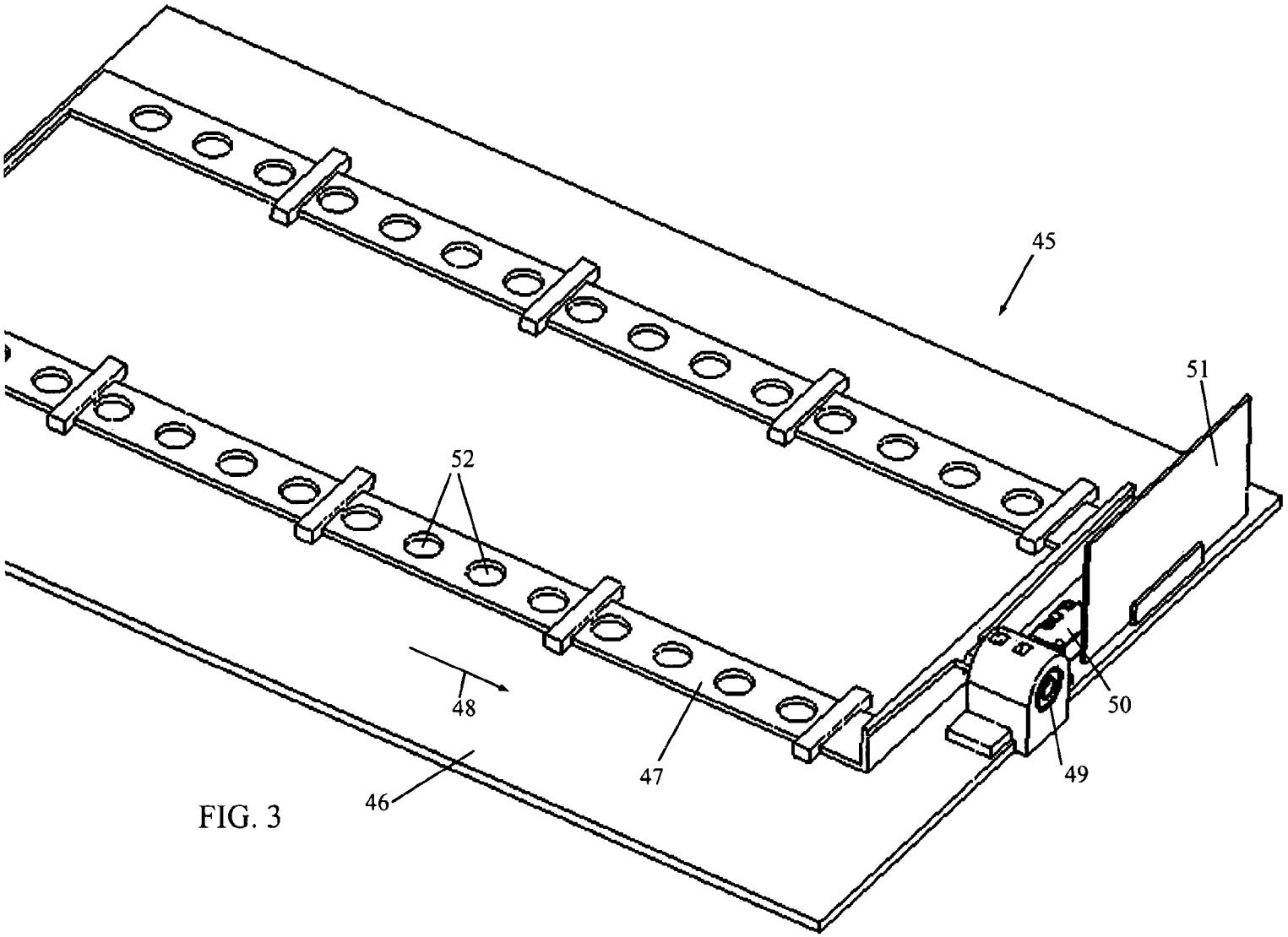
FIG. 3 is a simplified pictorial illustration of a refill actuation assembly of the vending machine assembly of FIGS. 1A-1D, constructed and operative in accordance with an embodiment of the present invention.

Reference is now made to FIG. 3, which illustrates a refill actuation assembly 45, constructed and operative in accordance with an embodiment of the present invention. Refill actuation assembly 45 includes a base plate 46 on which is mounted a link arm 47. Link arm 47 is arranged for linear movement along axis 48 and this movement is controlled and actuated by a lock 49. Turning lock 49 with a key (not shown) causes movement of link arm 47 along axis 48 in a manner known in the art. Thus, lock 49 is provided for locking and unlocking the refill actuation assembly 45. Operation of link arm 47 may be mechanical or may alternatively be electrical, controlled by a refill switch 50 and processing circuitry 51. Refill switch 50 may be used to cut-off the action of sensor (microswitch) 44 during refilling, in order to prevent false billing when opening the compartments for refilling. Processing circuitry 51 is operative to collect the sensor signals from each of the compartments, and to generate a consumption report delivered by RF or data cable to the billing mainframe. Link arm 47 is formed with a plurality of holes 52.

Refill actuation assembly 45 is coupled to stopper 32 with link arm 47 (as will be seen in the following figures). As will be described below, link arm 47 has a first position that retains stopper 32 in a stop position that prevents closing the compartment 12 unless the merchandise 54 has been removed and a second position that releases stopper 32 from the stop position to permit closing and opening door 14 for refilling compartment 12.

Figure 4A:
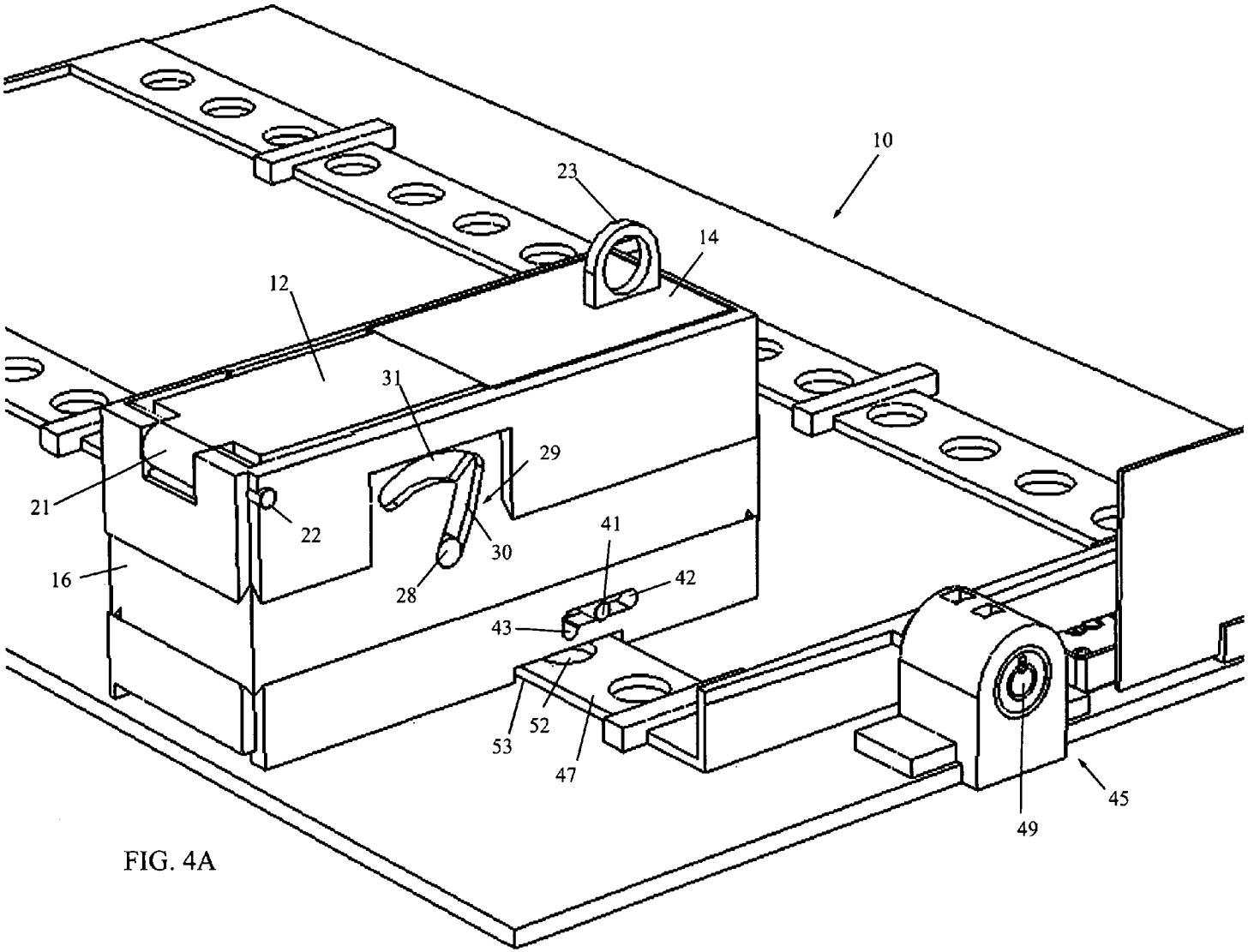
FIGS. 4A-4B are simplified pictorial and side-view illustrations, respectively, of one of the compartments on the refill actuation assembly, with the compartment in a closed position.
Figure 4B:
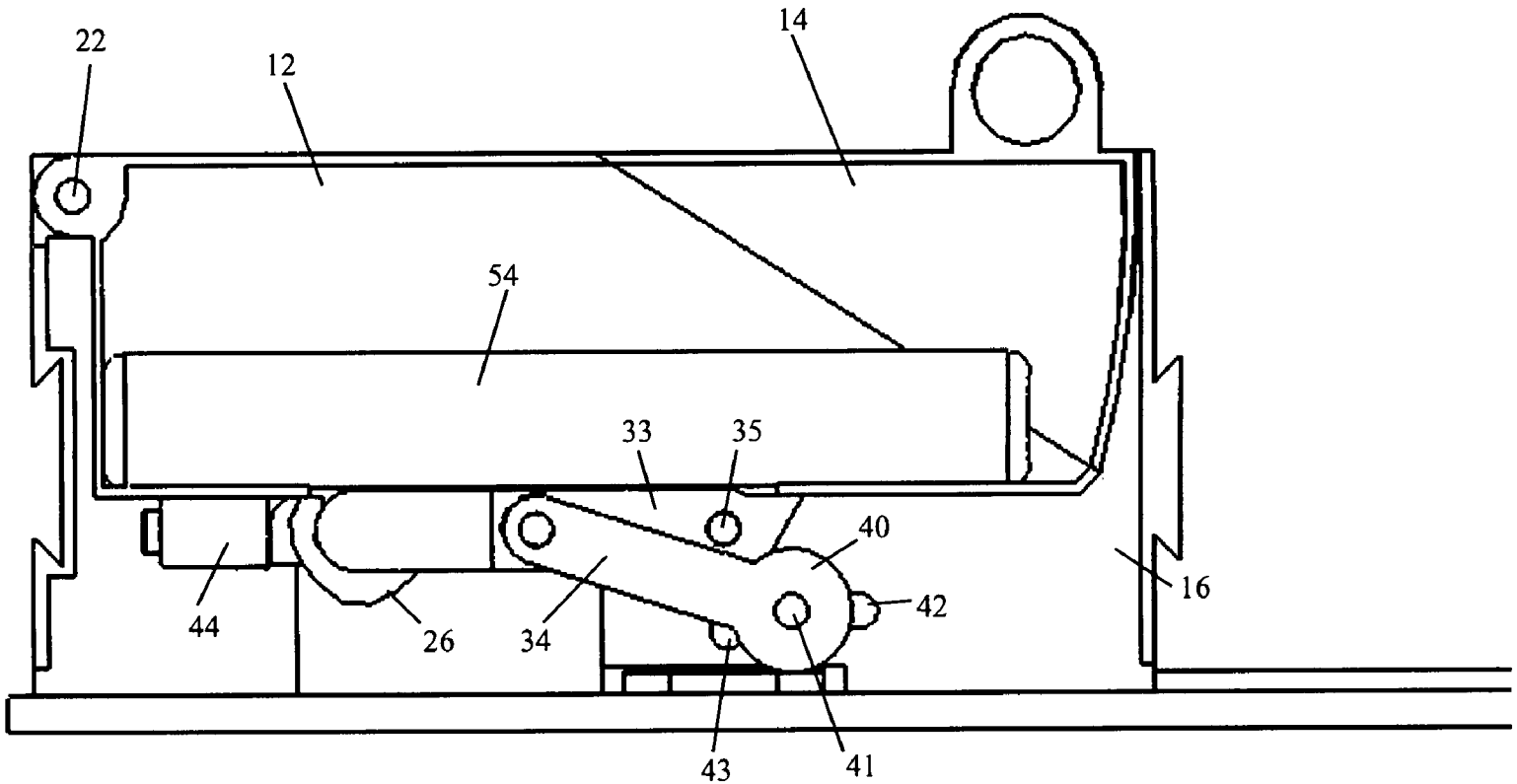

Reference is now made to FIGS. 4A-4B, which illustrate one of the compartments 12 on the refill actuation assembly 45. Compartment 12 is in a closed position. It is noted that link arm 47 is received in groove 53 formed at the bottom of box assembly 16. Merchandise 54 is seen in compartment 12 in FIG. 4B. It is noted that sensor 44 is closed by leg 26 of door 14.

Figure 5A:
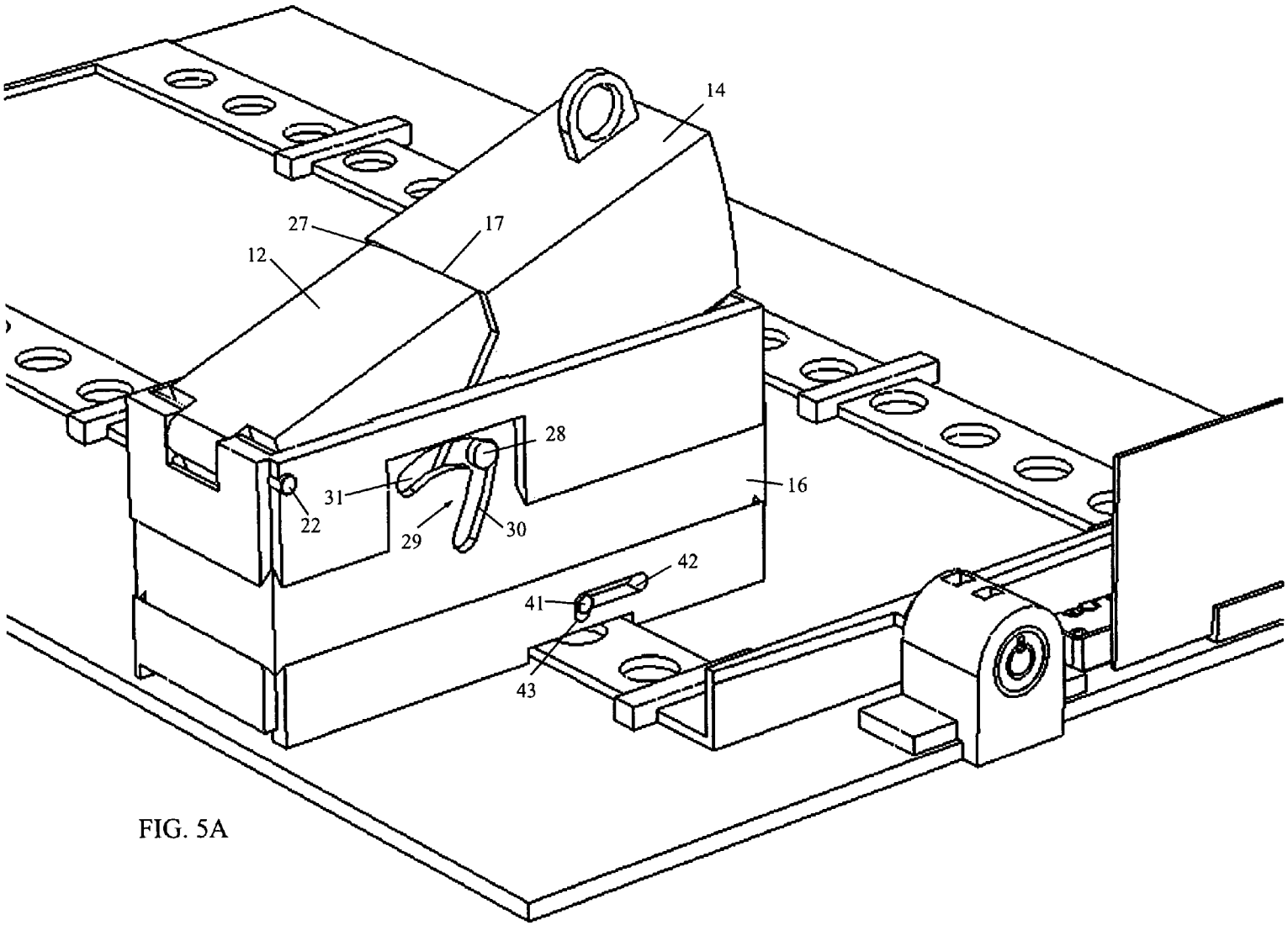
FIGS. 5A-5B are simplified pictorial and side-view illustrations, respectively, of one of the compartments on the refill actuation assembly, with the compartment in a lifted position, but with the compartment cover still closed.
Figure 5B:
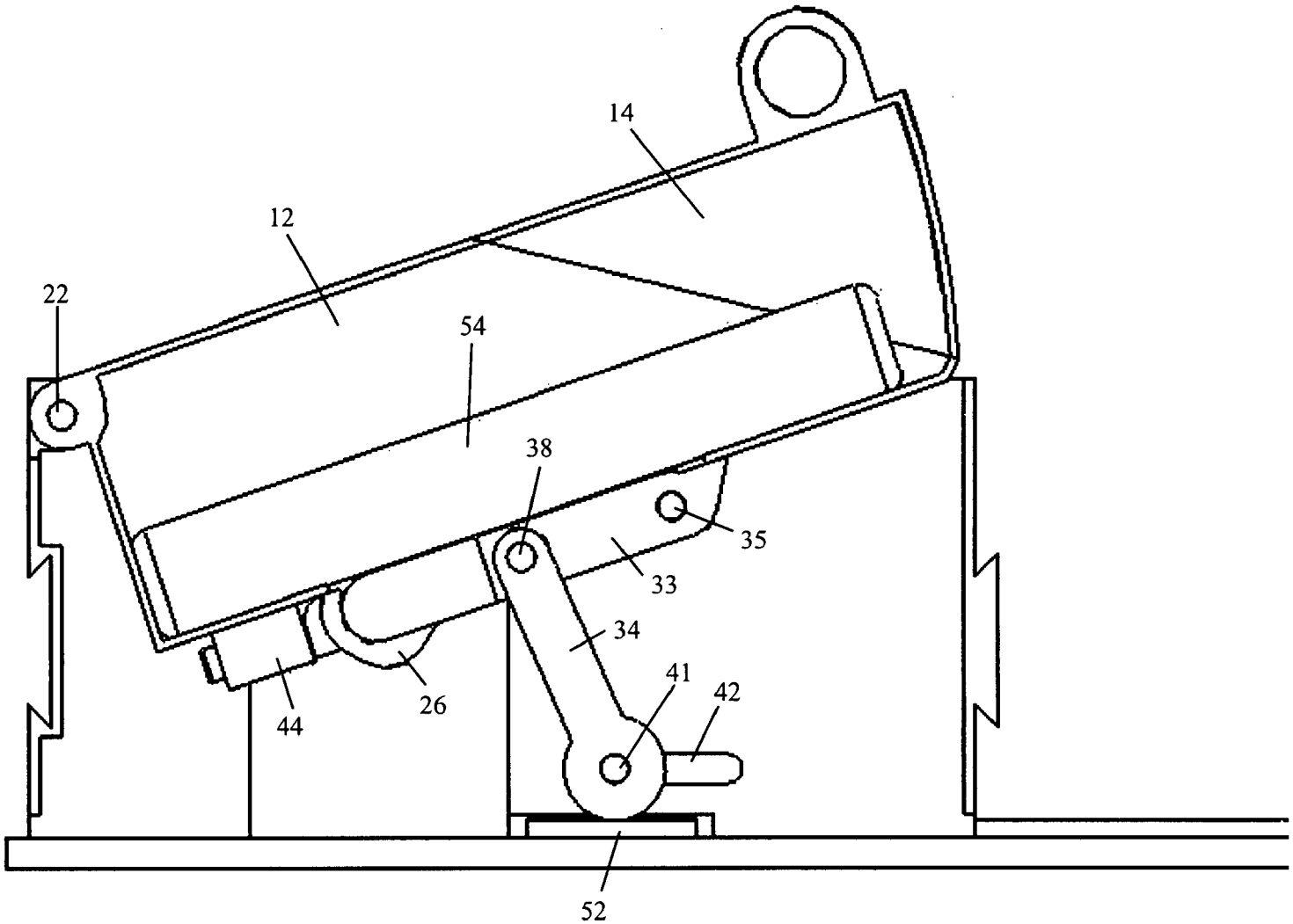

Reference is now made to FIGS. 5A-5B, which illustrate the compartment 12 in a lifted position. During travel of link element 28 in first portion 30 of track 29, the edge 27 of door 14 abuts against edge 17 of compartment 12. Thus, up to the upper end of first portion 30 of track 29, door 14 cannot pivot with respect to compartment 12 and instead lifts compartment 12, that is, pivots compartment 12 about axle 22, due to the abutment of edges 17 and 27. Note that during the movement of link element 28 in first portion 30 of track 29, rod 41 moves along lower track 42 formed in box assembly 16 towards extension 43. Sensor 44 is still closed by leg 26 of door 14.

Figure 6A:
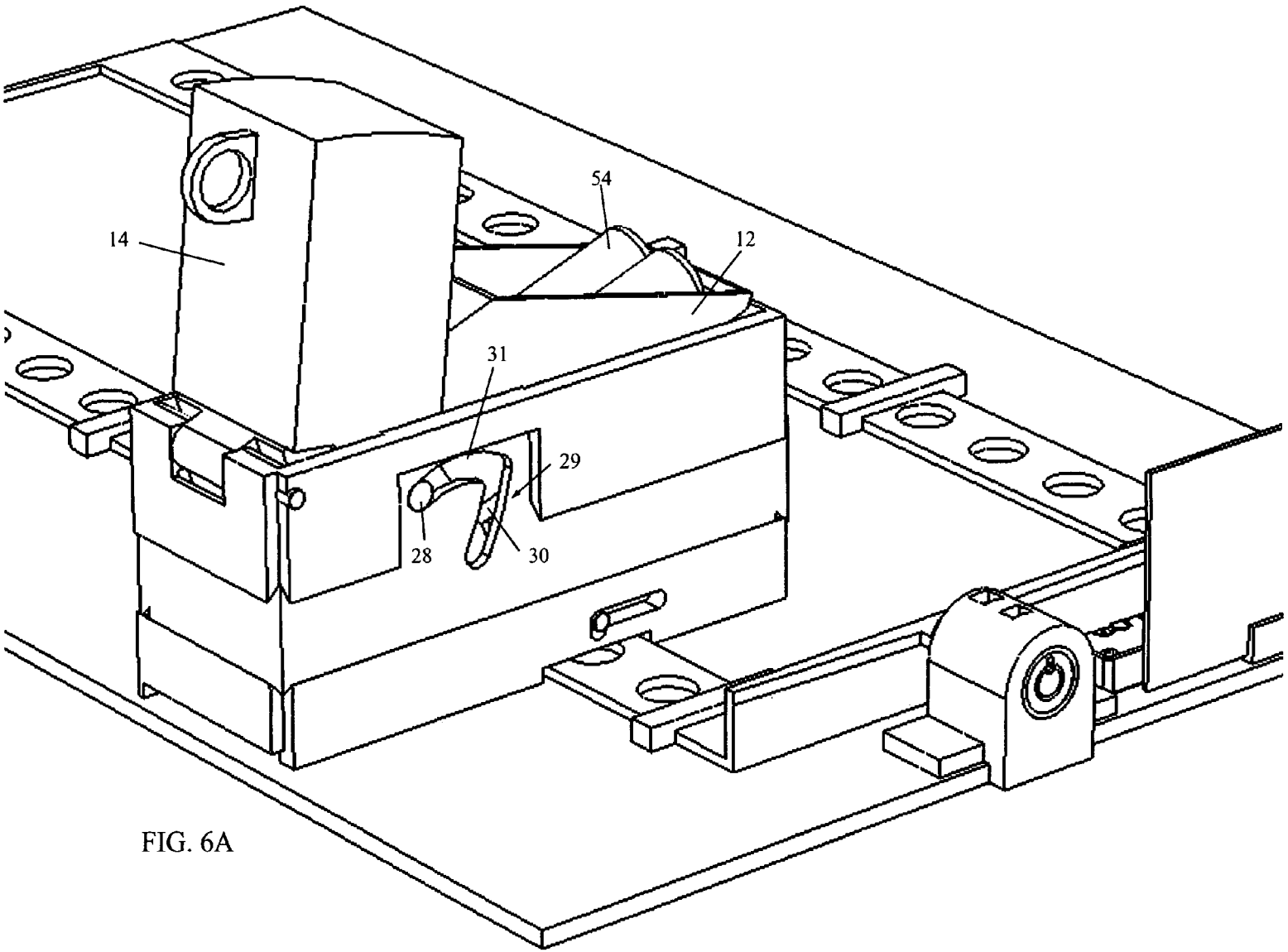
FIGS. 6A-6B are simplified pictorial and side-view illustrations, respectively, of one of the compartments on the refill actuation assembly, with the compartment in a lifted position and the compartment cover opened, wherein the item inside the compartment may now be removed from the compartment.
Figure 6B:
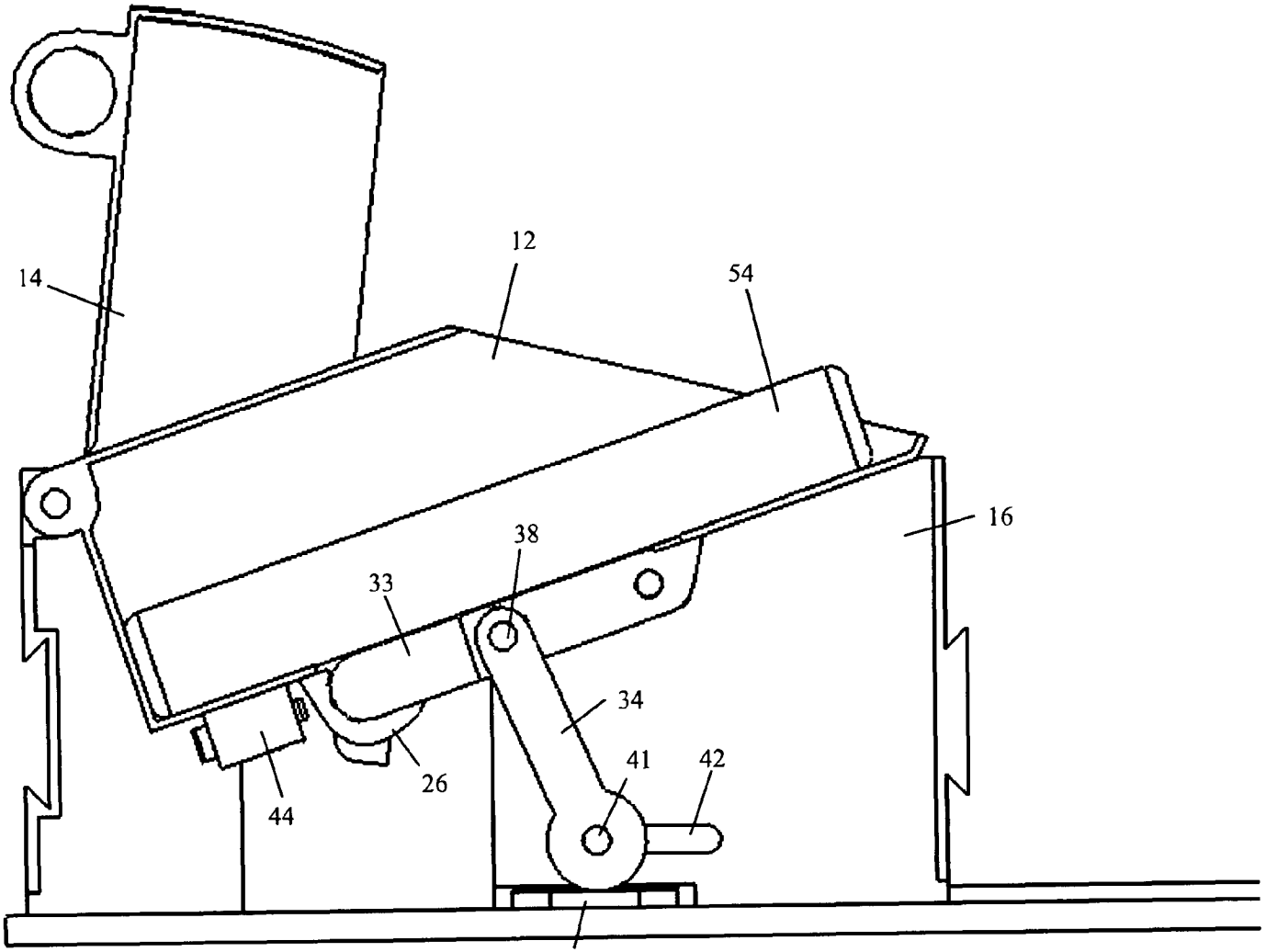

Reference is now made to FIGS. 6A-6B, which illustrate door 14 (i.e., the compartment cover) opened, due to link element 28 moving in second portion 31 of track 29. The merchandise 54 may now be removed from compartment 12. It is noted that sensor 44 is no longer closed by leg 26 of door 14. The open state of sensor 44 may send a signal to processor 51 that records opening of the compartment 12. For example, the vending machine assembly of the present invention may be used in a hotel. Upon opening of compartment 12, the sensor 44 signals that the guest should be billed for taking out the particular merchandise from the particular compartment.

Figure 7A:
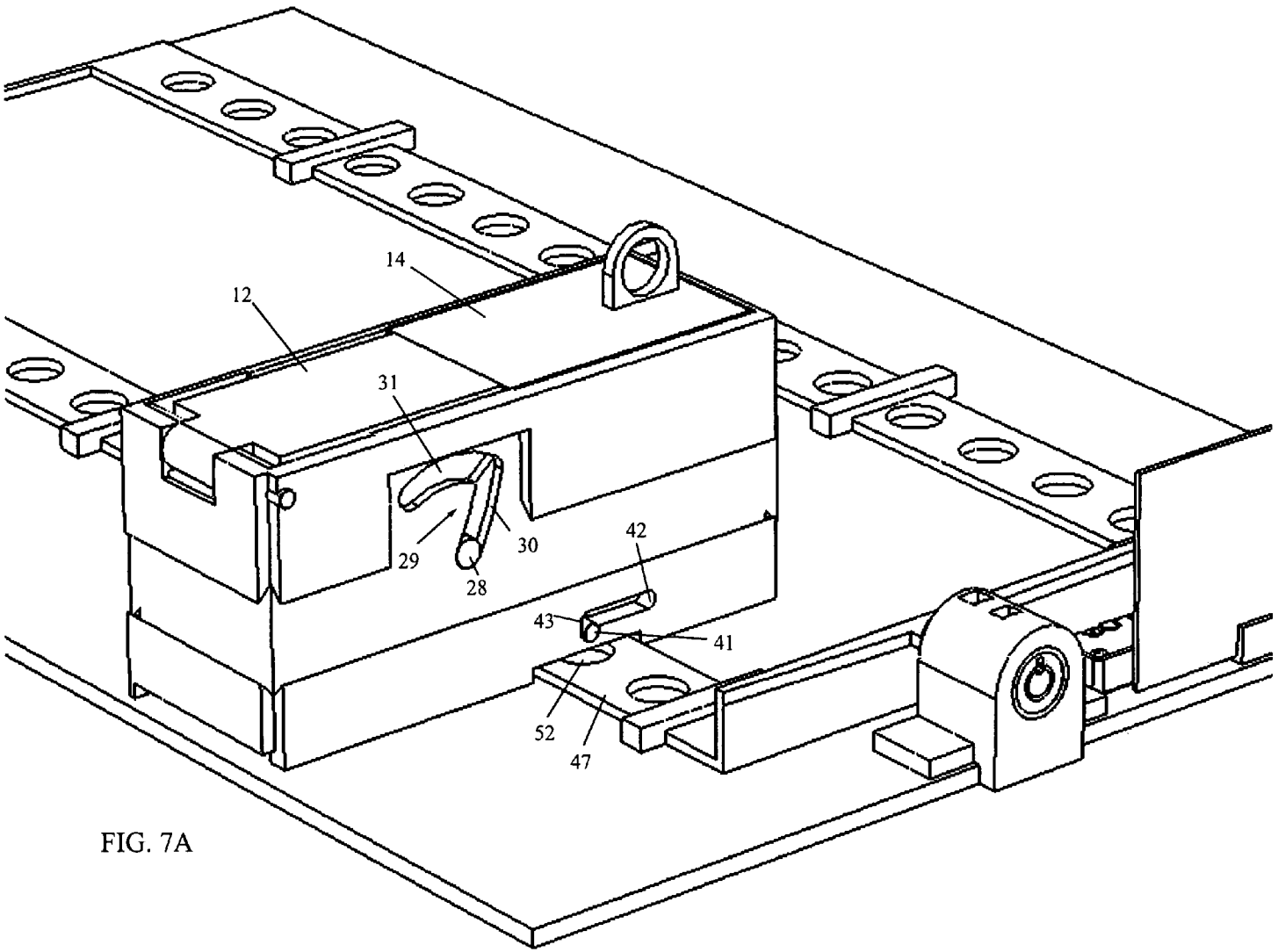
FIGS. 7A-7B are simplified pictorial and side-view illustrations, respectively, of one of the compartments on the refill actuation assembly, with the empty compartment returned to the closed position, the item having been removed from the compartment.
Figure 7B:
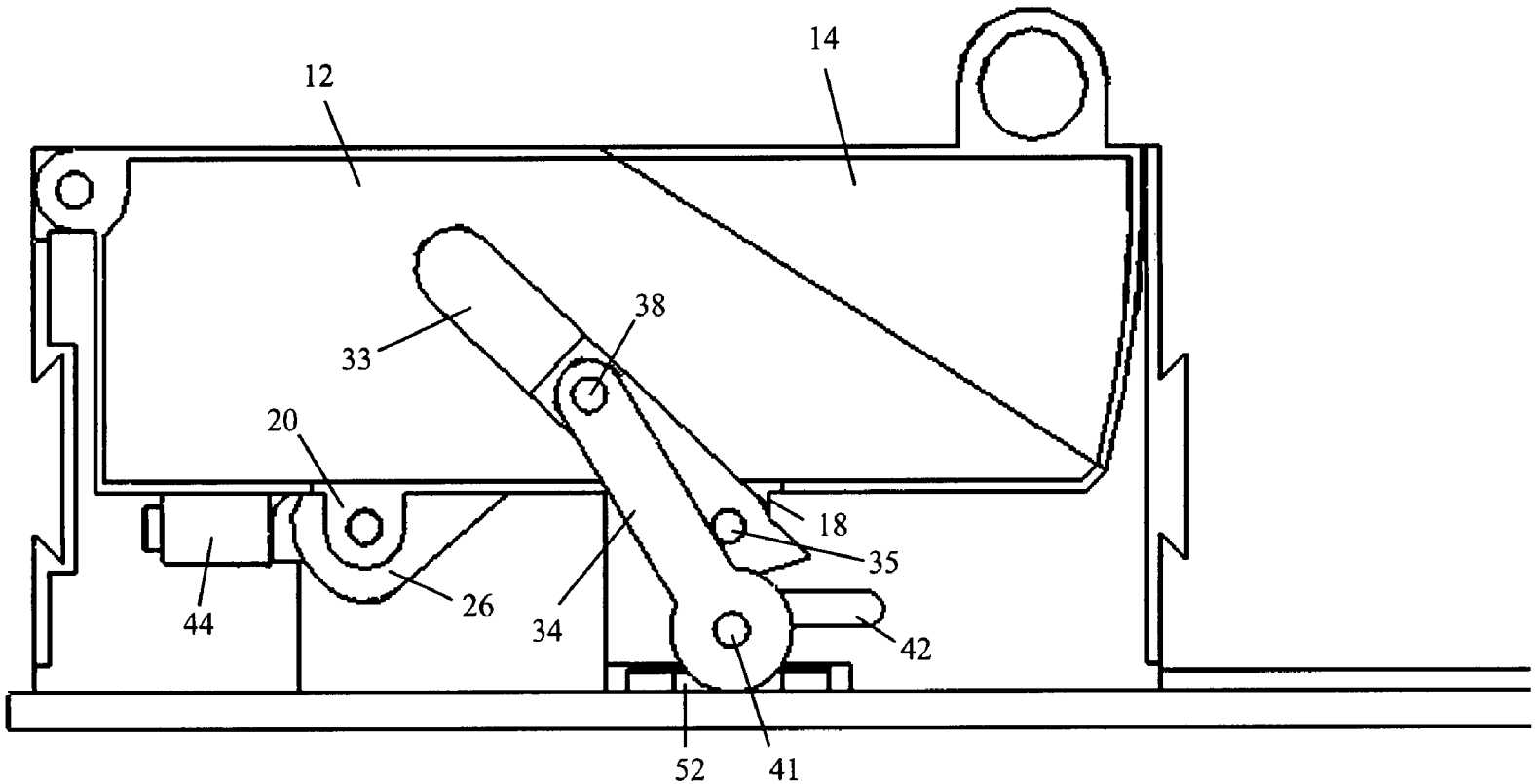

Reference is now made to FIGS. 7A-7B, which illustrate the now empty compartment 12 returned to the closed position. If the merchandise were still in compartment 12, the stopper element 33 would push the merchandise up, not allowing compartment 12 to close. In this position, rod 41 has moved along lower track 42 and has dropped into extension 43. Simultaneously spherical end 40 of leg element 34 drops in to one of the holes 52 of link arm 47 of refill actuation assembly 45. Rod 41 and thus stopper element 33 are now geometrically locked in extension 43. This provides a solution to a problem of the prior art, which is also solved by U.S. Pat. No. 7,513,390 to Artsiely, the disclosure of which is incorporated herein by reference. As mentioned above, if the vending machine is in a guest room, for example, guests can take out merchandise and get billed at checkout time. If the possibility exists that a person can place the item back in the vending machine, a dishonest person can take out the item and yet falsely claim later that he put back the item and refuse to pay for it, so as to get around paying for the beverage can and the like at checkout. The stopper element 33 thus prevents the dishonest person from placing the merchandise or any foreign item back in the vending machine.

Figure 8A:
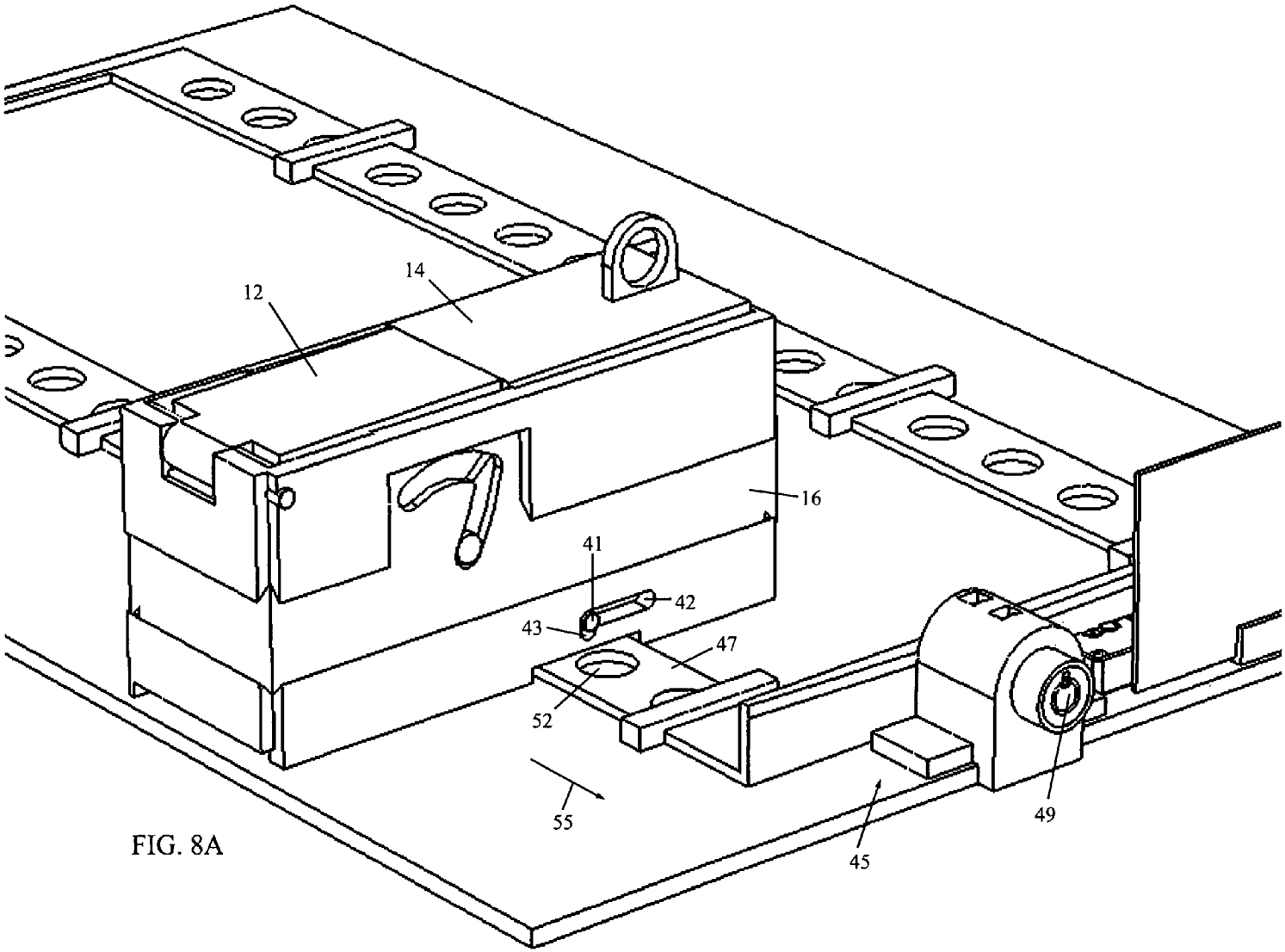
FIGS. 8A-8B are simplified pictorial and side-view illustrations, respectively, of one of the compartments on the refill actuation assembly, with the refill actuation assembly actuated so that the compartment can now be refilled.
Figure 8B:
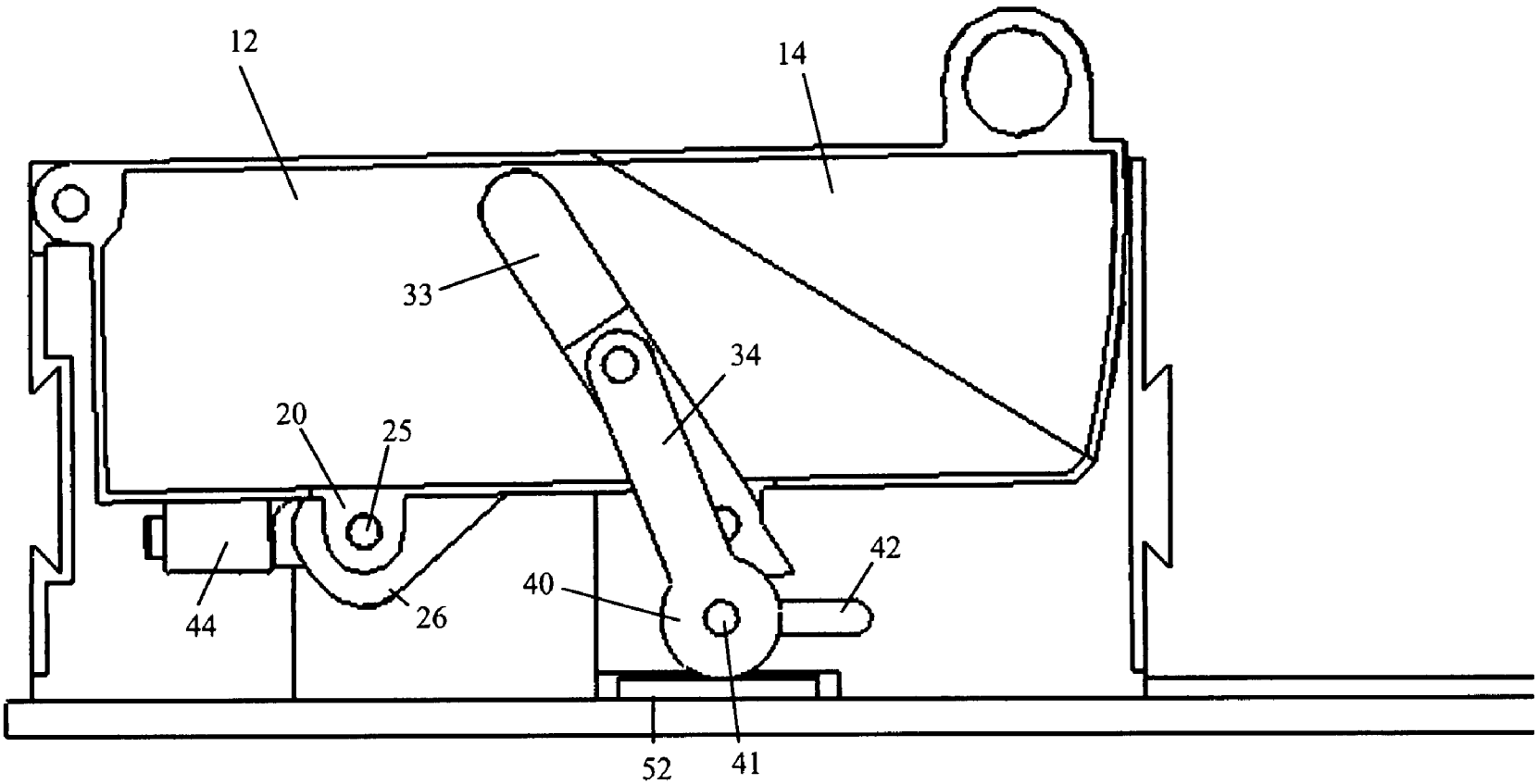

Reference is now made to FIGS. 8A-8B. Lock 49 is actuated to move link arm 47 of refill actuation assembly 45 in the direction of arrow 55. This lifts and releases rod 41 out of extension 43 to track 42, by lifting spherical end 40 of leg element 34 out of the hole 52 of link arm 47 of refill actuation assembly 45. In this position, stopper element 33 can now go down, door 14 can be opened and closed and compartment 12 can be refilled with merchandise. In this position, switch 50 is pushed, preventing any signal from the microswitch to be recorded as consumption.

Figure 9A:
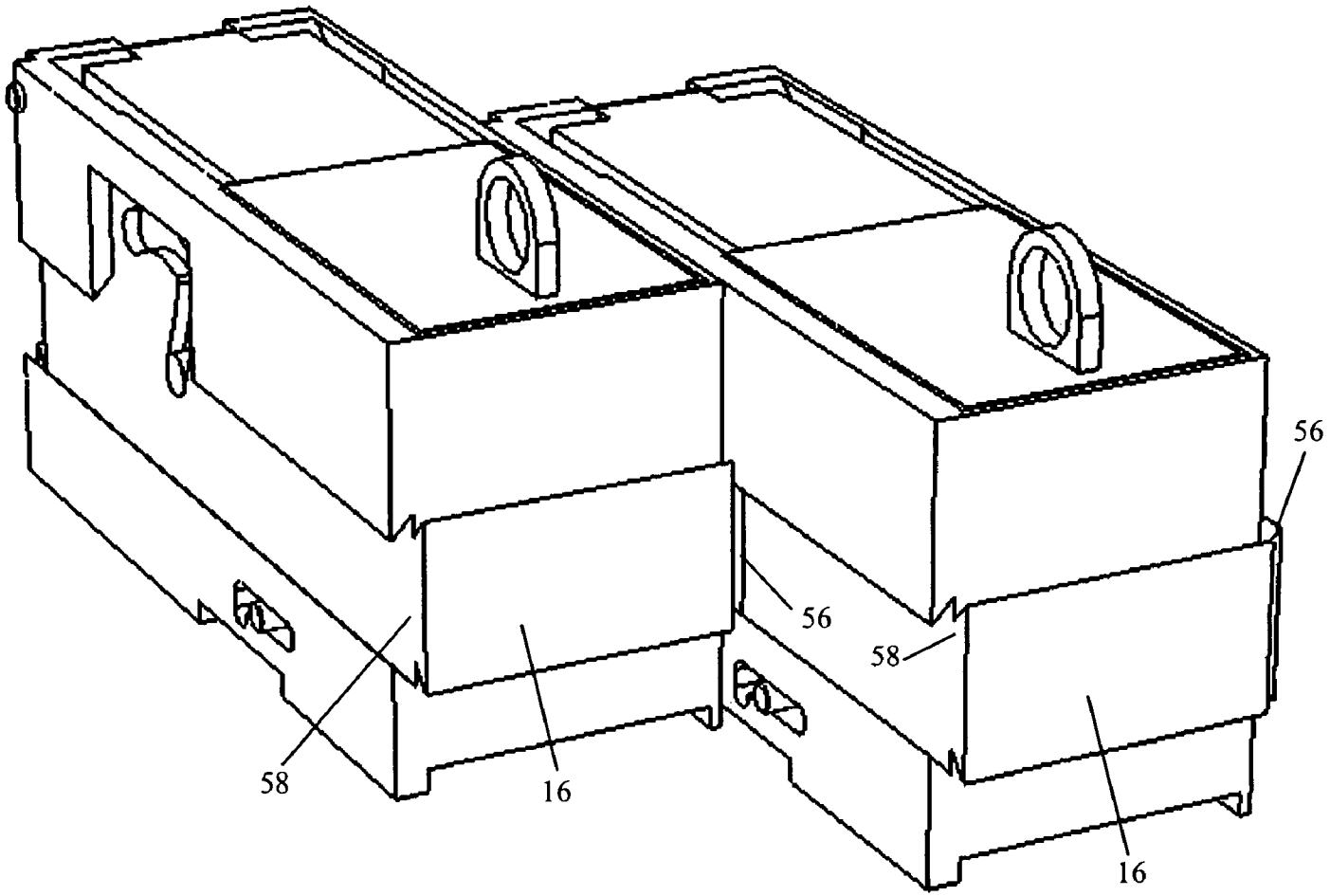
FIGS. 9A-9B are simplified pictorial and side-view illustrations, respectively, of the box assembly with first and second connectors, constructed and operative in accordance with an embodiment of the present invention.
Figure 9B:
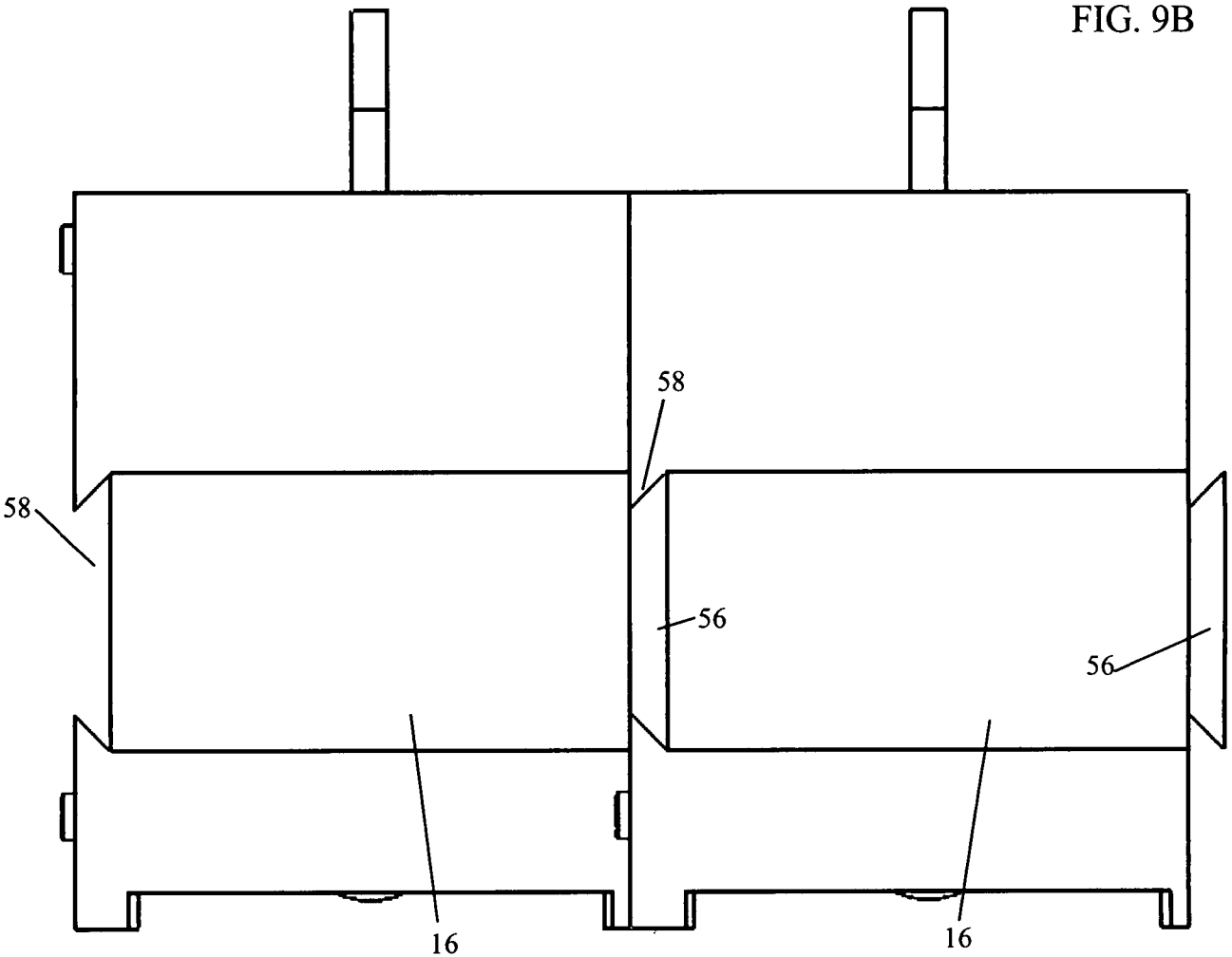

Reference is now made to FIGS. 9A-9B. In accordance with an embodiment of the present invention the box assembly 16 includes a first connector 56 and a second connector 58. Adjacent box assemblies 16 mate with each other by the first connector 56 of one of the box assemblies mating with the second connector 58 of an adjacent box assembly. For example, the first and second connectors may include male and female connectors (e.g., dovetail connectors).

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. Apparatus comprising:

a vending machine compartment comprising a dispensing door openable to permit removal of merchandise from said compartment, said compartment being pivotedly connected to a box assembly, and wherein said dispensing door comprises a link element that is constrained to move along a track formed in said box assembly such that said dispensing door is not openable at a first portion of said track and is openable at a second portion of said track;

a stopper positioned relative to said compartment, such that said stopper is deployed to a stop position that prevents closing said compartment unless merchandise has been removed from said compartment; and further comprising a refill actuation assembly coupled to said stopper with a link arm, said link arm having a first position that retains said stopper in said stop position and a second position that releases said stopper from said stop position to permit closing and opening said compartment for refilling said compartment.

2. The apparatus according to claim 1, wherein at the first portion of said track, said compartment pivots together with said dispensing door with respect to said box assembly.

3. The apparatus according to claim 1, wherein at the first portion of said track, said dispensing door is constrained to abut against said compartment and at the second portion of said track said dispensing door is free to pivot and open without abutting against said compartment.

4. The apparatus according to claim 1, wherein said stopper is geometrically locked at said stop position.

5. The apparatus according to claim 1, further comprising a lock for locking and unlocking said refill actuation assembly.

6. The apparatus according to claim 1, further comprising a sensor that senses when said dispensing door is open.

7. The apparatus according to claim 1, wherein said box assembly comprises a first connector and a second connector and said apparatus comprises more than one box assembly, wherein adjacent box assemblies mate with each other by the first connector of one of the box assemblies mating with the second connector of an adjacent box assembly.

8. The apparatus according to claim 7, wherein said first and second connectors comprises male and female connectors.

9. Apparatus comprising:

a vending machine compartment comprising a dispensing door openable to permit removal of merchandise from said compartment;

a stopper positioned relative to said dispensing door, such that upon removal of merchandise from said compartment, said stopper is deployed to a stop position that prevents closing said compartment; and a refill actuation assembly coupled to said stopper with a link arm, said link arm having a first position that retains said stopper in said stop position and a second position that releases said stopper from said stop position to permit closing and opening said compartment for refilling said compartment, wherein said box assembly comprises a first connector and a second connector and said apparatus comprises more than one box assembly, wherein adjacent box assemblies mate with each other by the first connector of one of the box assemblies mating with the second connector of an adjacent box assembly.

10. The apparatus according to claim 9, wherein said first and second connectors comprises male and female connectors.

11. The apparatus according to claim 9, further comprising a lock for locking and unlocking said refill actuation assembly.

12. The apparatus according to claim 9, wherein said stopper is geometrically locked at said stop position.

* * * * *